US009440137B2

(12) United States Patent
Trabucchi

(10) Patent No.: US 9,440,137 B2
(45) Date of Patent: Sep. 13, 2016

(54) TOE-PIECE FOR SKI-TOURING BINDINGS

(71) Applicant: SKI TRAB S.r.l., Bormio (SO) (IT)

(72) Inventor: Daniele Trabucchi, Bormio (IT)

(73) Assignee: SKI TRAB S.r.l. (IT)

( * ) Notice: Subject to any disclaimer, the term of this patent is extended or adjusted under 35 U.S.C. 154(b) by 0 days.

(21) Appl. No.: 14/716,439

(22) Filed: May 19, 2015

(65) Prior Publication Data

US 2015/0328529 A1 Nov. 19, 2015

(30) Foreign Application Priority Data

May 19, 2014 (IT) ..... M12014A0901

(51) Int. Cl.

| | |
|---|---|
| ***A63C 9/00*** | (2012.01) |
| ***A63C 9/10*** | (2012.01) |
| ***A63C 9/08*** | (2012.01) |
| ***A63C 9/085*** | (2012.01) |
| ***A63C 9/086*** | (2012.01) |

(52) U.S. Cl.

CPC ..... *A63C 9/10* (2013.01); *A63C 9/002* (2013.01); *A63C 9/086* (2013.01); *A63C 9/0807* (2013.01); *A63C 9/08528* (2013.01)

(58) Field of Classification Search

CPC ..... A63C 9/10; A63C 9/002; A63C 9/0807; A63C 9/08528; A63C 9/086; A63C 9/00; A63C 9/08557; A63C 9/08578; A63C 9/08585; A63C 9/08507; A63C 9/08514; A63C 2201/06; A63C 9/02

USPC ..... 280/614, 615, 635

See application file for complete search history.

(56) References Cited

U.S. PATENT DOCUMENTS

| | | | | | |
|---|---|---|---|---|---|
| 4,322,090 | A * | 3/1982 | Loughney | A63C 9/0807 | 280/614 |
| 4,322,092 | A * | 3/1982 | Feucht | A63C 9/20 | 280/615 |
| 4,526,398 | A * | 7/1985 | Sedlmair | A63C 9/02 | 280/615 |
| 8,439,389 | B2 * | 5/2013 | Moore | A63C 7/12 | 280/11.33 |
| 9,120,002 | B2 * | 9/2015 | Barthel | A63C 9/006 | |
| 9,155,956 | B2 * | 10/2015 | Rullier | A63C 9/0807 | |
| 2011/0271557 | A1 * | 11/2011 | Barthel | A43B 5/0423 | 36/117.1 |
| 2013/0214513 | A1 * | 8/2013 | Barthel | A63C 9/0807 | 280/614 |
| 2013/0328289 | A1 * | 12/2013 | Vailli | A63C 9/003 | 280/625 |
| 2014/0021696 | A1 * | 1/2014 | Soldan | A63C 9/0807 | 280/625 |
| 2014/0159345 | A1 * | 6/2014 | Indulti | A63C 9/0805 | 280/614 |

* cited by examiner

*Primary Examiner* — John Walters
*Assistant Examiner* — Brian Swenson
(74) *Attorney, Agent, or Firm* — Mintz Levin Cohn Ferris Glovsky and Popeo, P.C.

(57) ABSTRACT

A toe-piece for ski-touring bindings includes a base plate coupled to two jaws. The base plate provided with holes for fixing by screws to the surface of a ski extending in the longitudinal direction from a front tip to a rear tail-end. The two jaws situated opposite each other and symmetrically with respect to a longitudinal axis. Each of the two jaws having a transverse arm and a vertical arm provided with a respective transverse conical pin, which arms are configured to rotate about an axis substantially parallel to the base plate and to the longitudinal direction between a closed and/or open position for retaining and/or inserting and releasing the toe of a ski-boot and an open and/or closed position for releasing and inserting and/or retaining the toe.

12 Claims, 5 Drawing Sheets

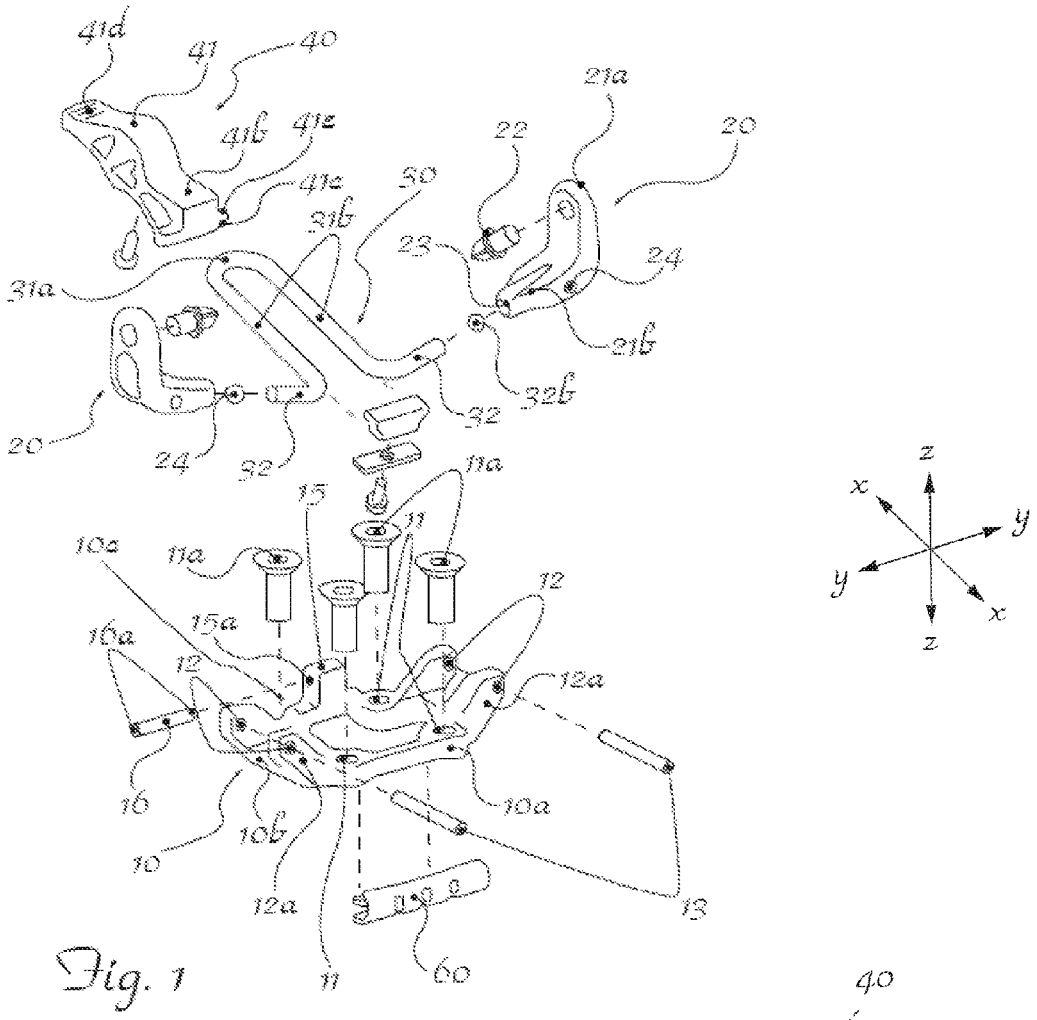
Fig. 1
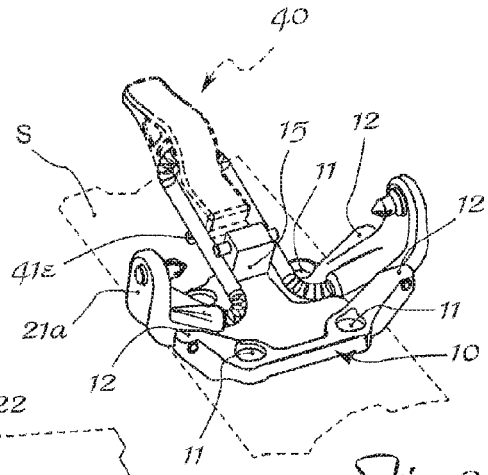
Fig.2
Fig.3
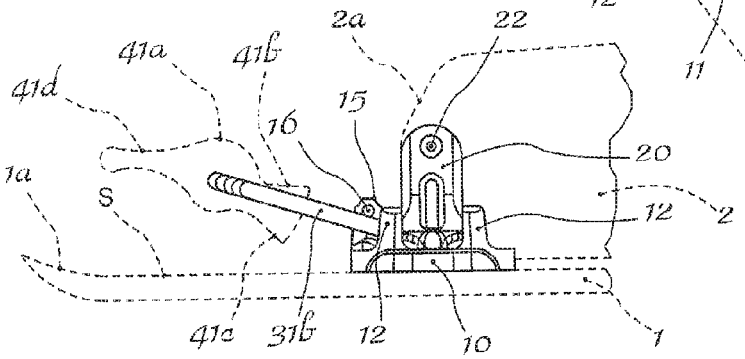

TOE-PIECE FOR SKI-TOURING BINDINGS

RELATED APPLICATION

This application claims priority under 35 U.S.C. §119 to Italian Patent Application No. MI2014A000901 filed on May 19, 2014, the entire content of which is hereby expressly incorporated by reference herein.

TECHNICAL FIELD

The present subject matter relates to a toe-piece for ski-touring bindings.

BACKGROUND

It is known, in the technical sector of ski-touring, that there exists the need to provide safety bindings including a front element or toe-piece, designed to retain the toe of the ski-boot while allowing rotation of the boot about an axis, which is transverse to the longitudinal direction of extension of the ski from tip to tail end and is substantially horizontal, and a rear element, or heel-piece, designed to cooperate with the heel of the boot so as to allow three different modes of use, i.e.: release of the heel (normal walking); resting of the heel with greater/lesser inclination of the boot (uphill walking) and locking of the heel (downhill skiing).

In this connection, it is also known that the existing bindings of the type described above have, however, two main drawbacks. First, the toe-piece does not have independent means for releasing the boot in the transverse direction, as required in the event of a fall or a twisting movement during downhill skiing. Rather, in conventional systems, the safety is achieved by corresponding means for operating the rear heel-piece, which is consequently much more complex and heavy and results in an assembly with poor rigidity, particularly with respect to the rear fastening of the boot to the ski, with a consequent worsening in the downhill performance.

Second, closing of the toe-piece in traditional designs is performed by means of a front-end lever, which cooperates with springs arranged transversely in the toe-piece, resulting in a complicated mechanical assembly and a high overall weight of the toe-piece.

It is also known that in the case of athletes taking part in ski-touring racing competitions or in the case of ski-touring amateurs, there is an increasing desire to reduce the weight of the ski-touring bindings to reduce the load and improve the uphill performance. This has resulted in minimalist binding solutions, which are unable to ensure any safety release system, resulting in the skier being exposed to the risk of injury.

In addition, these known toe-pieces have complex mechanical sets of springs and connection elements that tend to jam and not work properly at low temperatures, owing to the formation of ice.

SUMMARY

One technical problem posed, therefore, is that of providing a ski-touring binding toe-piece designed to perform locking of the toe of the boot with the rigidity normally required for these applications and with the possibility of rotation of the toe about a horizontal axis, which toe-piece is formed by a small number of parts so as to obtain a smaller overall weight and a reduction in the number of malfunctions resulting from the particular conditions of use during ski-touring. In addition it is desirable that the toe-piece should allow improved adjustment of opening of the toe-piece—independently of the action of the heel-piece—so as to allow the toe of the boot to come out safely when subject to torsional/transverse forces. In connection with this problem it is also required that this toe-piece should have small dimensions, be easy and inexpensive to produce and assemble and be able to be easily applied to skis using normal standardized connection means.

These results may be achieved according to embodiments of the present subject matter by a toe-piece for ski-touring bindings that includes a base plate coupled to two jaws situated opposite each other and symmetrical with respect to a longitudinal axis, each with a transverse arm and a vertical arm provided with a respective conical pin, which arms are designed to rotate about an axis substantially parallel to the base plate between a closed position for retaining the toe of a boot and an open position for inserting/releasing the toe, as well as a single-piece elastic element able to be operated rotationally and cooperating with the transverse arms so as to determine different opening/closing positions of the toe-piece.

The elastic element may be operated from a raised rest position for retaining the jaws in the closed position for holding the toe of the boot, into a lowered position for rotationally operating the jaws into the open position for inserting/releasing the toe of the boot, or vice versa pulled from a lowered rest position with the jaws in the open position for inserting/releasing the toe of the boot into a raised position for rotationally operating the jaws into the closed position for holding and retaining the toe of the boot.

In one embodiment the elastic element may be designed in the form of a "U" with longitudinal arms having free ends bent outwards and inserted inside the jaws of the toe-piece.

In an aspect, a toe-piece for ski-touring bindings may extend in a longitudinal lengthwise direction of the toe-piece, transverse widthwise direction and vertical direction and include a base plate coupled to two jaws. The base plate may be provided with holes for fixing by screws to the surface of a ski extending in the longitudinal direction from a front tip to a rear tail-end. The two jaws may be situated opposite each other and symmetrically with respect to a longitudinal axis. Each of the two jaws may have a transverse arm and a vertical arm provided with a respective transverse conical pin, and in some embodiments each arm may be configured to rotate about an axis substantially parallel to the base plate and to the longitudinal direction between a closed and/or open position for retaining and/or inserting and releasing the toe of a ski-boot and an open and/or closed position for releasing and inserting and/or retaining the toe. The two jaws may include a single-piece elastic element with two ends cooperating with the transverse arms and operable from a rest position, corresponding to the closed and/or open position of the two jaws, to a rotated and elastically deformed position for rotationally operating the two jaws into the open and/or closed position for inserting and releasing and/or retaining the toe of the ski-boot inside the toe-piece.

One or more of the following features can be included in any feasible combination. For example, the elastic element in the rest position can be rotatable upwards and/or raised in response to a pressure applied thereon. The elastic element in the rest position can be rotatable downwards and/or lowered in response to a pulling force applied thereon.

The base plate can include a first pair of protruding uprights and a second pair of vertical uprights. The first pair of protruding uprights can be situated opposite each other in the longitudinal direction and can be arranged along a first longitudinal edge of the base plate. The second pair of vertical uprights can be situated opposite each other in the longitudinal direction and can be arranged, symmetrically with respect to the first pair, on a second longitudinal edge of the base plate opposite to the first edge. Each upright can have a longitudinal through-hole designed to receive a longitudinal pin for constraining the corresponding jaw to the respective uprights. The pin can form a longitudinal axis for rotation of the respective jaw between the normal closed position and the open position.

The elastic element can be formed by a U-shaped body with a base and arms. The base of the "U" can extend in the transverse direction and can be positioned in front of and outside of the base plate in the longitudinal direction. The arms of the "U" can extend in the longitudinal direction from the base and can have a respective rear free end bent outwards in the transverse direction and towards a respective seat of the transverse arm of the respective jaw, inside which seat they can be stably housed. The free ends of the elastic element can be connected to the respective longitudinal arm by means of a curved section forming a relative angle in a plane parallel to the base plate and an acute angle with a plane parallel to the base plate.

The base can have a relief arranged along its front transverse edge and extending in the transverse direction by an amount slightly smaller than the interaxial distance between the two longitudinal arms of the U-shaped elastic element and such as to allow insertion between the arms in the vertical direction. The relief can have a through-hole in the transverse direction in a relief top part and suitable for inserting a transverse pin. The pin can have a length such that its opposite ends project transversely from the relief overlapping the longitudinal arms of the "U", in order to interfere with them in the vertical direction and prevent them from coming out. The flat parts of the base, adjacent to the sides of the relief, can form a reaction fulcrum for rotation of the longitudinal arms of the elastic element. An operating lever can be arranged in front of the base plate and can be formed by a body extending in the longitudinal direction and having a central transverse eyelet inside which the transverse base of the "U" of the body of the elastic element is inserted. The base can form a transverse axis of rotation of the lever.

Means for adjusting the elastic resistive force of the elastic element of the toe-piece can be included, thereby adjusting the safety release value of the toe-piece. The adjusting means can include a slider with opposite transverse ends, which can be suitably concave for engagement with the arms 31*b*) of the "U" on which the slider may slide in the longitudinal direction. Adjusting means can further include a locking plate, the opposite ends of which can press against the arms of the "U" and can be locked to the slider by means of a fixing grub-screw.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Further details may be obtained from the following description of non-limiting examples of embodiments of the present subject matter, provided with reference to the accompanying drawings, in which:

FIG. 1 is an exploded view of the toe-piece according to the present subject matter;

FIG. 2 is a perspective view of the toe-piece according to FIG. 1 in the rest condition with the jaws closed;

FIG. 3 is a side view of the toe-piece shown in FIG. 1;

Like reference symbols in the various drawings indicate like elements.

DETAILED DESCRIPTION

Figure 4:
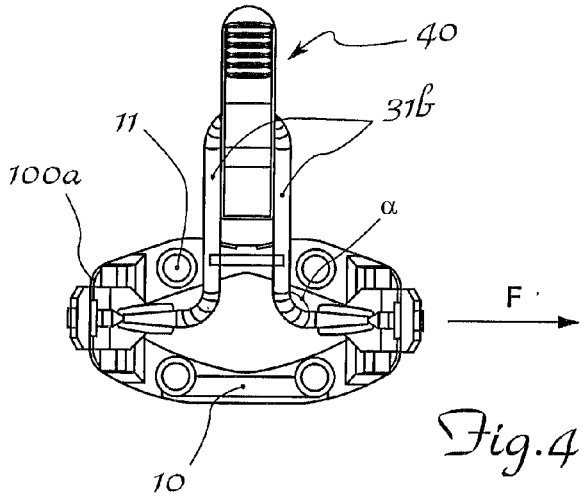
FIG. 4 is a top plan view of the toe-piece shown in FIG. 1.
Figure 5:
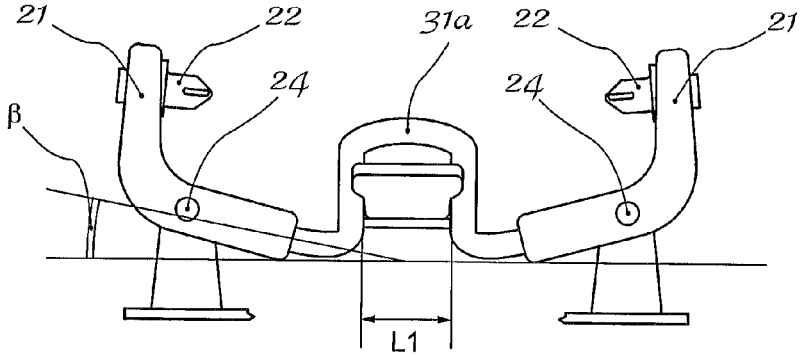
FIGS. 5 and 6 show, respectively, a front view and top plan view of the detail of the jaws of the toe-piece and the elastic operating element in the condition where the toe-piece is closed.

As shown in FIG. 1 and with reference to the examples of orientation shown in the figures whereby the front is assumed to be the part of the toe-piece proximal, during use, to the tip of the ski 1 and the rear is assumed to be the opposite end, towards the tail end of the ski, and a set of three axes are conventionally assumed to be—merely for the sake of easier description—a longitudinal axis X-X along the length of the toe-piece, transverse axis Y-Y along the width and vertical axis Z-Z orthogonal to the first two axes, the toe-piece according to the subject matter includes a base plate 10. The base plate 10 extends substantially in the plane X-Y and is provided with holes 11 for fixing to the ski by means of corresponding screws 11*a*. The plate 10 includes a first pair of vertically protruding uprights (12) and a second pair of vertical uprights (12). The first pair of vertically protruding uprights (12) are situated opposite each other in the longitudinal direction X-X and arranged along a first longitudinal edge 10*a* of the base plate 10. The second pair of vertical uprights 12 are situated opposite each other in the longitudinal direction X-X and arranged, symmetrically with respect to the first pair 12, on the longitudinal edge 10*b* of the base plate 10 opposite to the first edge. Each upright 12 has a longitudinal through-hole 12*a* designed to receive a longitudinal pin 13.

The base 10 can also have a relief 15 arranged along its front transverse edge 10*c* and extending in the transverse direction Y-Y by an amount slightly smaller than the interaxial distance L between two longitudinal arms 31*b* of a U-shaped elastic element 30 described below, so as to allow the arms 31*b* to pass in the vertical direction Z-Z. In its top part the relief 15 can have a through-hole 15*a* in the transverse direction Y-Y suitable for inserting a transverse pin 16 with a length such that its opposite ends 16*a* project transversely from the relief 15 by an amount such as to overlap the longitudinal arms 31*b* of the "U", so as to interfere with them and prevent them from coming out during the various stages of operation of the toe-piece.

The base 10 can have, connected thereto, first and second jaws 20 situated opposite each other and symmetrical with respect to a longitudinal axis X-X approximately passing through the center of the toe-piece. Each jaw 20 can be formed by a vertical arm 21, a transverse arm 21*b*, an elastic element 30 with base 31*a*, arms 31*b*, and free end 32. The vertical arm 21 can be substantially perpendicular to the base 10 and can be provided with a respective conical pin 22 extending in the transverse direction Y-Y towards the inside of the toe-piece parallel to the base and designed to engage with a respective seat in the toe 2*a* of a ski-boot 2 (only schematically indicated by means of broken lines in FIG. 3). The transverse arm 21*b* can be substantially parallel to the base 10, the inner free end of which can have a seat 23 extending towards the inside of the support arm.

Figure 7:
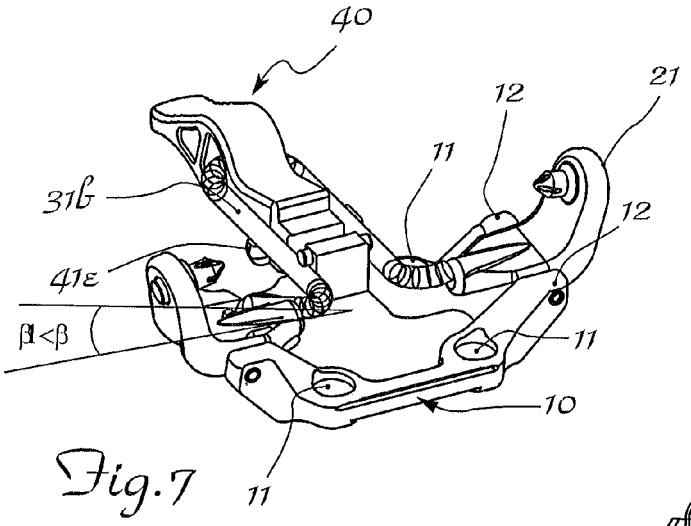
FIGS. 7 and 8 show, respectively, a perspective and top-plan view of the toe-piece according to the present subject matter in the condition where the jaws are open for inserting the toe of the boot.
Figure 8:
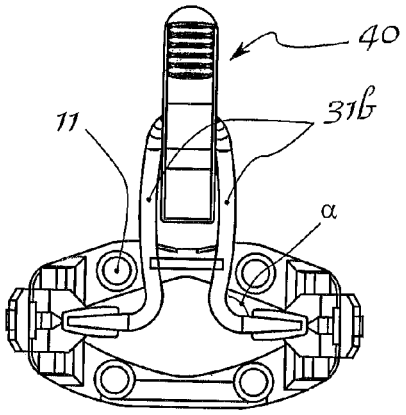

Each jaw 20 also can have a transverse through-hole 24 formed in the longitudinal direction X-X. The through-hole 24 can be designed to receive one of the pins 13, which therefore forms the element for constraining the jaw to the respective uprights 12 and a longitudinal axis of rotation of the respective jaw between a normal closed rest position for holding the toe of the boot (FIGS. 2 and 3) and an open position (FIGS. 7 and 8) designed to allow the toe of the boot to enter inside the toe-piece.

The elastic element 30 preferably formed by a single body in the form of a "U" with base 31*a* extending in the transverse direction Y-Y and positioned in front of and outside of the base plate 10 in the longitudinal direction X-X. Arms 31*b* of the "U" extend in the longitudinal direction from the base 31*a*. Arms 31*b* can have a respective rear free end 32 bent outwards in the transverse direction Y-Y and towards the respective seat 23 of the transverse arm 21*b* of the respective jaw 20. The free end 32 can be connected to the respective longitudinal arm 31*b* by means of a curved section forming a relative angle $\alpha$ in the plane X-Y and an acute angle $\beta$ with a plane (X-Y) parallel to the base plate 10. A variation in the angle $\beta$ will determine a relative elastic deformation of each end 32 and the respective longitudinal arm 31*b*, the effects of which as regards operation of the toe-piece will emerge more clearly below.

Each end 32 of the spring can be housed inside the respective seat 23 of the jaw 20. In some implementations, the ends 32 are housed inside the respective seat with slight play, so as to allow a minimum freedom of relative movement between the end and seat, without however the possibility of the former coming out of the latter.

In an example embodiment, a small ball 32*b* can be arranged between the free end 32 of the arm 31*b* and the blind bottom of the respective seat 23 and is designed to facilitate rotation of the spring inside the seat during operation thereof.

In the example of embodiment shown in FIGS. 1-5, the elastic element 30 can therefore be operated by means of pressure applied to the base 31*a* of the "U" so as to switch from a raised rest position for keeping the jaws 20 in the closed position for holding the toe of the boot, into a lowered position, for rotational operation of the jaws towards the open position for inserting the toe. The flat parts of the base 10 adjacent to the sides 15*a* of the raised element 15 form the reaction fulcrum for rotation of the arms 31*b*. In addition, the sides 15*a* of the raised element 15 can act as reaction fulcrums for transverse deformation (curving) of the arms 31*b* during opening of the jaws 20.

In some example implementations, the transverse base 31*a* of the "U" can be inserted inside a respective central transverse eyelet 41*a* of an operating lever 40 arranged in front of the toe-piece and the boot. The operating lever 40 can be formed by a body 41 extending in the longitudinal direction X-X. In this way, the base 31*a* of the "U" forms a transverse axis of rotation of the lever 40.

The body 41 of the lever includes at least one part 41*b* behind the eyelet 41*a* in the longitudinal direction X-X, with a transverse dimension Y-Y suitable for being contained between the arms 31*b* of the "U" and having a free rear front surface 41*c*, which is substantially flat for resting on the top surface S of the ski. The bottom free end 41*b* of the lever 40 also can have two teeth 41*e* projecting outwards in opposite senses of the transverse direction Y-Y and designed to prevent rotation of the lever 40 by abutting against the lower respective arm 31*b* of the "U".

The front free end 41*d* of the lever 40 can be configured so that a user may easily operate, in particular, easily pushed downwards in the vertical direction Z-Z.

As will become clear below, the operating lever 40 facilitates operation of the elastic element 30 and therefore opening of the jaws 20 into the position for inserting the toe of the boot as well as locking of the elastic element and therefore the jaws in the closed position for holding the toe of the boot.

Figure 9:
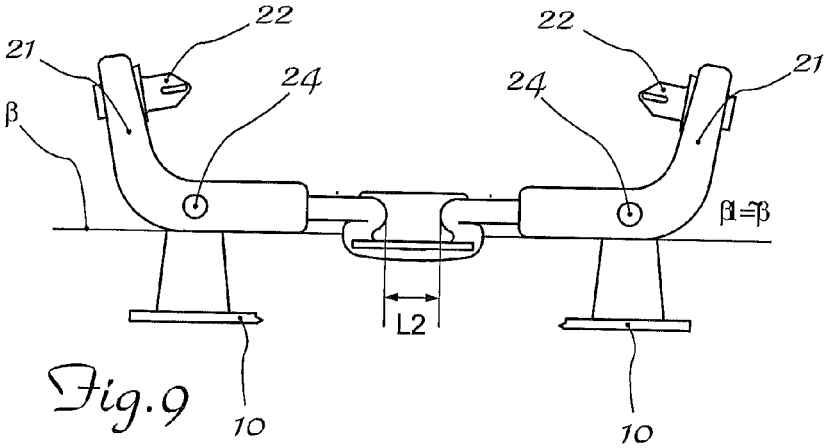
FIGS. 9 and 10 show, respectively, a front view and top plan view of the detail of the jaws of the toe-piece and of the elastic operating element in the condition where the toe-piece is open.
Figure 10:
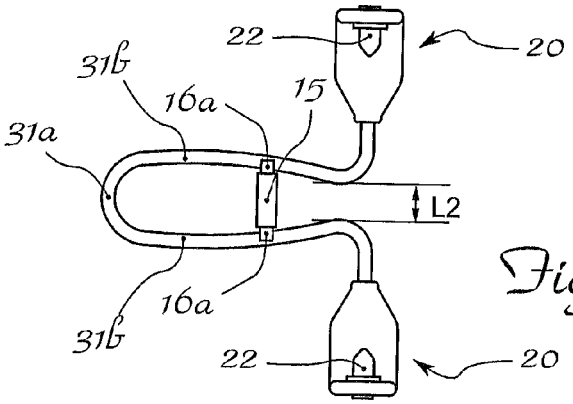

With the configuration described above, a normal rest position (FIGS. 2-3) of the toe-piece can include jaws 20 in the closed position, U-shaped elastic means (in the example shown fitted with an example operating lever 40) with arms 31*b* of the "U" raised in the vertical direction Z-Z and operating lever 40 arranged parallel to the arms with the rear part 41*b* inserted between the arms 31*b* and rotationally locked by the teeth 41*e* bearing against the arms 31*b*. In operation, a pressure can be applied, substantially in the vertical direction Z-Z, onto the base of the "U" of the elastic element 30, by pressing downwards (FIG. 7) the free front end 41*d* of the lever 40. The pressure, since it is locked on the arms 31*b* of the "U" by the teeth 41*e*, causes lowering of the base 31*a* and consequent upwards rotation of the opposite end of the arms 31*b*. Arms 31*b* are connected to the bent ends 32 that undergo simultaneous elastic deformation. This produces a movement so that the opposite bent ends 32 converge towards each other in the transverse direction Y-Y and towards the inside of the toe-piece (the angle $\alpha$ is reduced ($\alpha'<\alpha$)) (FIG. 10). The respective curved connecting sections rise upwards in the vertical direction Z-Z, reducing the angle $\beta$ ($\beta'<\beta$)) (FIG. 9) and being deformed elastically with respect to the rest position. Opposite bent ends 32 push against the associated transverse arm 21*b* of the jaws 20 causing a clockwise rotation of the same about the respective pins 13 into an open position suitable for insertion of the boot.

Figure 6:
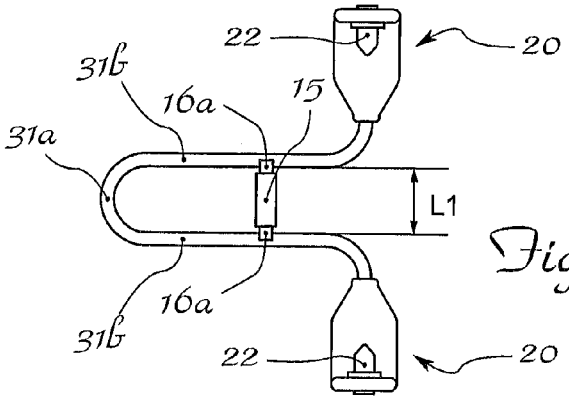

Releasing the front end of the lever 40 and therefore the base of the "U" causes the elastic return of the bent ends 32 towards the rest position. The counter-rotation and the elastic return of the elastic element 30 into the raised rest position (FIG. 6) with consequent rotation, in the opposite, counter-clockwise, direction of the jaws (FIG. 5), which return into the initial closed condition for holding the toe of the boot. Once the toe of the boot has been engaged it is possible to operate, if present, the operating lever 40, causing it to rotate in the clockwise direction in order to define different conditions of use.

Figure 15:
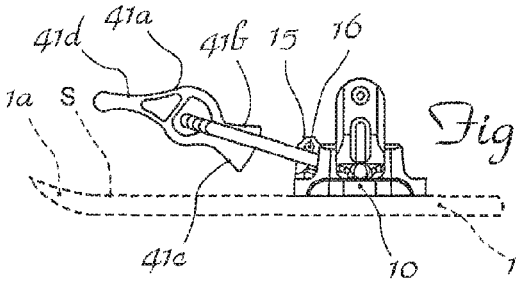
FIGS. 15, 16 and 17 show, respectively, side views of the different positions of the lever for operating the elastic element in the different conditions of use of the toe-piece.
Figure 16:
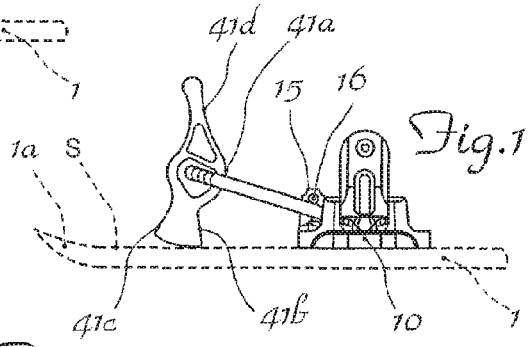
Figure 17:
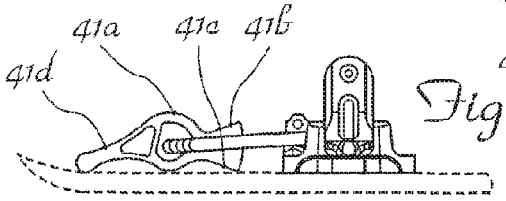

Lever 40 can be kept in the inclined position inside the arms 31*b* (FIG. 15). If the boot is acted on by transverse/torsional forces—schematically indicated by the arrow F—with sufficient modulus in the transverse direction Y-Y, a corresponding thrust is produced on the vertical arm 21*a* of the jaws 20, which rotates so as to open together with the transverse arms and against the resistive action of the elastic element 30. At this point two different conditions may occur: if the force F is not sufficiently high to manage to overcome the total resistance of the elastic element 30, the latter, reacting, will again bring the jaws 20 and therefore the entire toe-piece into the closed position, producing an automatic self-centring effect; or if the force F is such as to overcome the total resistance of the elastic element 30, the latter may no longer retain the jaws 20 which will rotate into their open position, causing release of the toe of the boot which will come out of the toe-piece.

If it is wished to walk uphill, a situation where the boot is constrained to the ski only at the toe, the operating lever 40 can be rotationally operated to bring the rear free surface 41*c* into contact against the top surface S of the ski. In this condition, the operating lever 40 locks the elastic means 30 in the raised position, preventing opening of the jaws 20. This option is advantageous also in extreme downhill skiing conditions, where it is required to avoid at all costs possible accidental safety release of the toe-piece.

By varying the resistance of the elastic element 30, it is possible to modify the safety release value of the toe-piece, it being therefore possible to choose a resistive force of the elastic element suitable for the weight and the skiing style of the athlete or end user. This may be achieved by varying the thickness/diameter of the arms 31*b* of the elastic element or the material from which they are made. For this purpose and as shown in FIGS. 11-14, it is also possible to fit means 50 for adjusting the elastic thrusting force acting on the jaws of the toe-piece to be able to modify the safety release value of the toe-piece and choose a resistive force of the elastic element which is most suited to the weight and skiing style of the athlete or end user.

Figure 11:
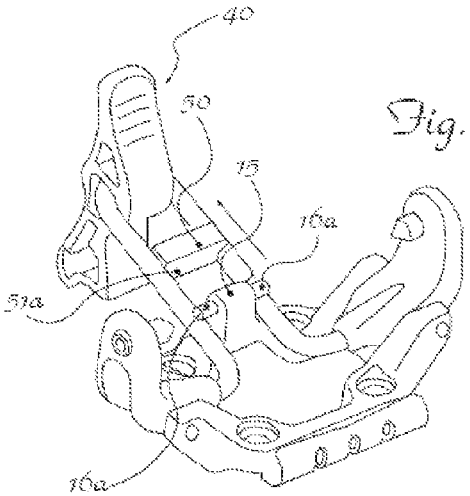
FIGS. 11 and 12 show, respectively, a view, from above, of the toe-piece according to the present subject matter with the means for adjusting the force of the elastic element and a top plan view of a first condition of deformation thereof.
Figure 12:
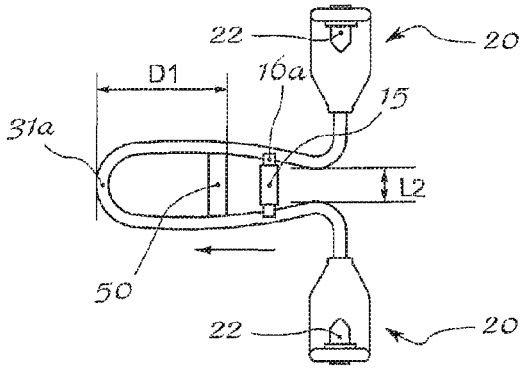
Figure 13:
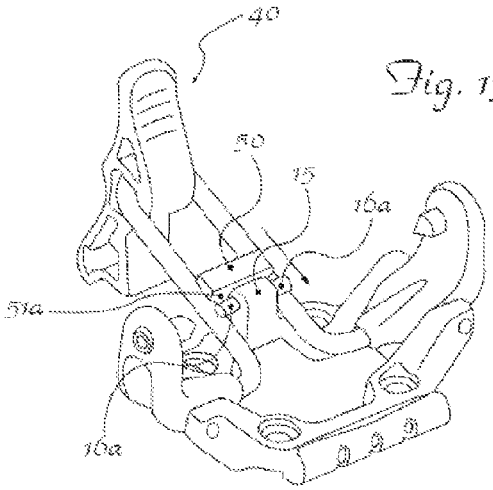
FIGS. 13 and 14 show respectively views, which are similar to those of FIGS. 11 and 12, for different adjustment of the force of the elastic element.
Figure 14:
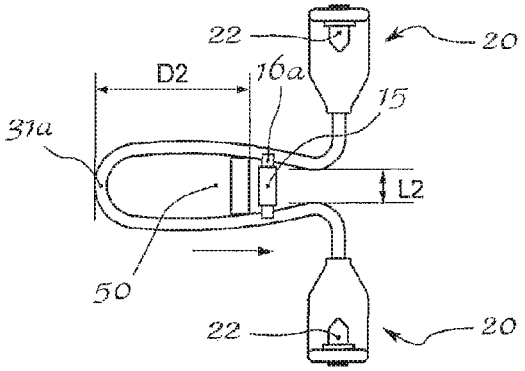

In detail, FIGS. 11 and 12 show an example embodiment of the adjusting means 50. Adjusting means 50 take the form of a slider 51 with suitably concave opposite transverse ends 51*a* for engagement with the arms 31*b* of the "U" on which it is therefore able to slide in the longitudinal direction from a position more retracted at the rear (FIGS. 11 and 12) to a position more advanced at the front (FIGS. 13 and 14). The presence of the slider 50 displaces the reaction fulcrum for curving of the elastic element 30 from the sides 15*a* of the raised part 15 to the concave sides 51*a* of the slider 50, resulting in a different overall elasticity of the elastic element and therefore resistance to release of the toe-piece.

The slider may be displaced in a substantially continuous manner, allowing a corresponding modulation of the resistance to release of the toe-piece. The slider may be locked by means of a locking plate 52 once the desired position has been reached, which may be marked by notches or an indication of the corresponding reaction kilograms. The locking plate 52 can be locked to the slider by means of a fixing grub-screw 53 and the opposite ends of which push against the arms 31*b* of the "U".

During use, the slider may be locked in position along the arms 31*b* by tightening the grub-screw 53 against the slider, while in order to vary the position of the slider it is sufficient to slacken the grub-screw, slide the slider to the desired position and then tighten again the grub-screw 53.

In some example implementations, the toe-piece may be provided with an element 60 for inserting so-called ski-touring rampants (shown only in FIG. 1) positioned at the rear, in the longitudinal direction X-X, of the base plate 100. The element 60 (FIG. 1) extends transversely and has a cross-sectional form (along a plane X-Z) which is substantially in the form of a "C" open towards the toe-piece itself and with a plate provided with holes for receiving the screws for fixing the base 100, it being fastened thereto by the screws once assembly has been performed.

Figure 18:
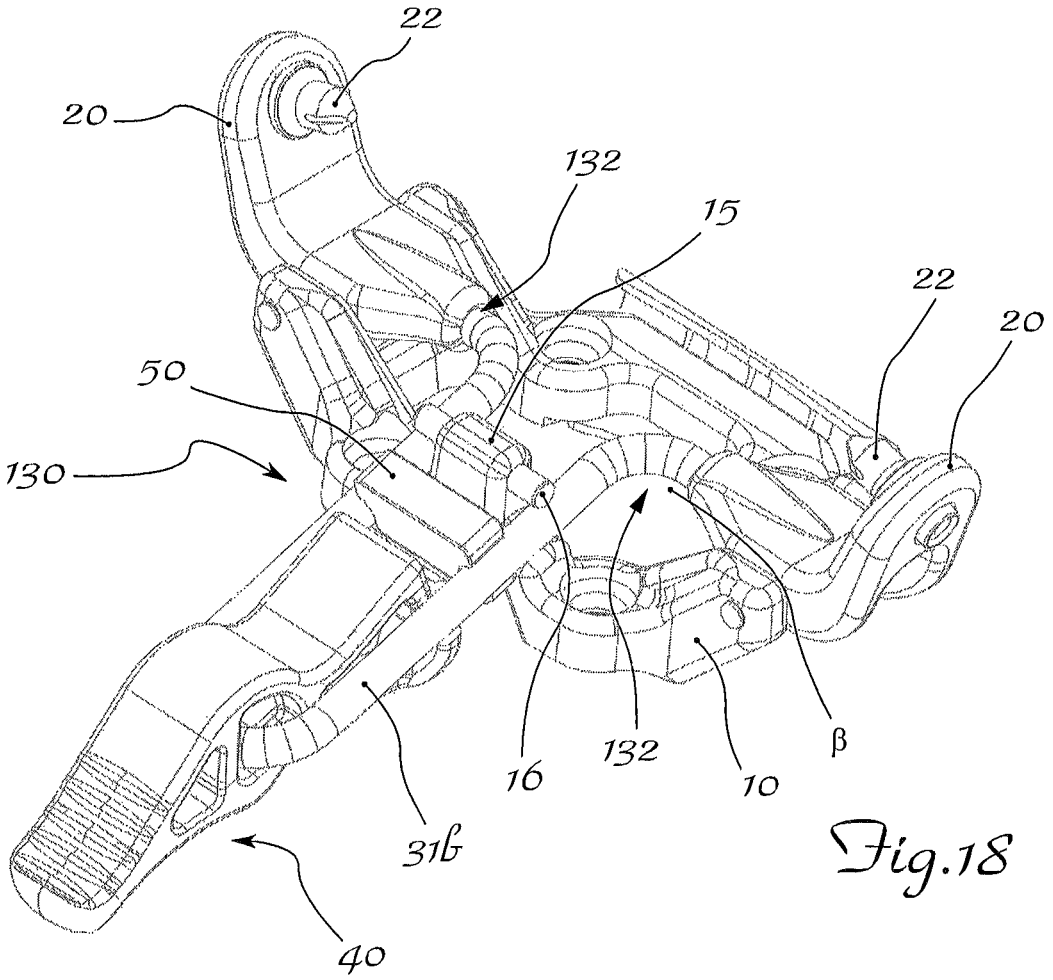
FIG. 18 shows an example of a variation of embodiment of the toe-piece according to the present subject matter.

As shown in FIG. 18, it is envisaged moreover that the toe-piece according to the present subject matter may be realized with a different configuration of the elastic element 130. Elastic element 130, in this example, has a relative angle β, between the bent ends 132 of the respective arms 31 and a plane parallel to the plane of the base plate, with a sign opposite to that of the preceding case. This results in a stable position of the elastic element 130 rotated in the anti-clockwise direction downwards and a consequent rest configuration of the toe-piece with jaws 20 rotated in the open position.

Operation of the toe-piece in this case occurs by means of a pulling force exerted on the base 31 of the elastic element 130. The pulling force causes the downwards rotation of the ends 132 connected to the jaws, resulting in elastic deformation of the former with respect to the corresponding arm 31*b* such as to bring the elastic element into a second stable position with the jaws rotated into the closed position for engagement with the toe of the boot.

In some implementations, the presence and the rotation of the operating lever 40 may determine the various conditions of use of the toe-piece, as already described for the first embodiment thereof.

It is therefore clear how, with the U-shaped elastic element according to the subject matter, it is possible to obtain a substantial simplification as regards both the number and weight of the components forming the toe-piece and therefore of the toe-piece as a whole, as well as simplification of its operation which is less prone to faulty operation resulting from the particular conditions of use which are typically associated with ski-touring.

In addition, owing to the particular simplified configuration, it is also possible to improve adjustment of the resistance to release of the toe-piece in the case of transverse and/or torsional forces imparted by the boot, thereby ensuring greater safety during use.

Although described in connection with a number of embodiments and a number of preferred examples of embodiment of the subject matter, it is understood that the scope of protection of the present disclosure will be determined solely by any claims issued thereon.

The invention claimed is:

1. A toe-piece for ski-touring bindings extending in a longitudinal lengthwise direction of the toe-piece, transverse widthwise direction of the toe-piece and vertical direction of the toe-piece, the toe-piece comprising:

a base plate provided with holes for fixing by screws to the surface of a ski extending in the longitudinal direction from a front tip to a rear tail-end, the plate coupled to:

two jaws situated opposite each other and symmetrical with respect to a longitudinal axis, each of the two jaws having a transverse arm and a vertical arm provided with a respective transverse conical pin, each of the transverse arm and vertical arm being configured to rotate about an axis substantially parallel to the base plate and to the longitudinal direction between a closed and/or open position for retaining and/or inserting and releasing the toe of a ski-boot and an open and/or closed position for releasing and inserting and/or retaining the toe; and a single-piece elastic element with two ends cooperating with the transverse arms of the two jaws and operable from a rest position, corresponding to the closed and/or open position of the two jaws, to a rotated and elastically deformed position for rotationally operating the two jaws into the open and/or closed position for inserting and releasing and/or retaining the toe of the ski-boot inside the toe-piece and wherein the elastic element is formed by a U-shaped body with:

a base of the U-shaped body extending in the transverse direction and positioned in front of and outside of the base plate in the longitudinal direction;

arms of the U-shaped body extending in the longitudinal direction from the base and having a respective rear free end bent outwards in the transverse direction and towards a respective seat of the transverse arm of the respective jaw, inside which seat they are stably housed.

2. The toe-piece according to claim 1, wherein the elastic element in the rest position is rotatable upwards and/or raised in response to a pressure applied thereon.

3. The toe-piece according to claim 1, wherein the elastic element in the rest position is rotatable downwards and/or lowered in response to a pulling force applied thereon.

4. The toe-piece according to claim 1, wherein the base plate comprises:

a first pair of protruding uprights situated opposite each other in the longitudinal direction and arranged along a first longitudinal edge of the base plate;

a second pair of vertical uprights situated opposite each other in the longitudinal direction and arranged, symmetrically with respect to the first pair, on a second longitudinal edge of the base plate opposite to the first edge;

each upright having a longitudinal through-hole designed to receive a longitudinal pin for constraining the corresponding jaw to the respective uprights, the pin forming a longitudinal axis for rotation of the respective jaw between the normal closed position and the open position.

5. The toe-piece according to claim 1, wherein the free ends of the elastic element are connected to the respective longitudinal arm by means of a curved section forming a relative angle in a plane parallel to the base plate and an acute angle with a plane parallel to the base plate.

6. The toe-piece according to claim 1, wherein the base plate has a relief arranged along its front transverse edge and extending in the transverse direction by an amount slightly smaller than the interaxial distance between the two longitudinal arms of the U-shaped elastic element and such as to allow insertion between the arms in the vertical direction.

7. The toe-piece according to claim 6, wherein the relief has a through-hole in the transverse direction in a relief top part and suitable for inserting a transverse pin, the pin having a length such that its opposite ends project transversely from the relief overlapping the longitudinal arms of the U-shaped body, in order to interfere with them in the vertical direction and prevent them from coming out.

8. The toe-piece according to claim 7, wherein the flat parts of the base, adjacent to the sides of the relief, form a reaction fulcrum for rotation of the longitudinal arms of the elastic element.

9. The toe-piece according to claim 1, comprising an operating lever, arranged in front of the base plate and formed by a body extending in the longitudinal direction and having a central transverse eyelet inside which the transverse base of the U-shaped body of the elastic element is inserted, the base forming a transverse axis of rotation of the lever.

10. The toe-piece according to claim 1, comprising means for adjusting the elastic resistive force of the elastic element of the toe-piece, thereby adjusting the safety release value of the toe-piece.

11. The toe-piece according to claim 10, wherein the adjusting means comprise a slider with opposite transverse ends, which are suitably concave for engagement with the arms of the U-shaped body on which the slider may slide in the longitudinal direction.

12. The toe-piece according to claim 11, wherein adjusting means further comprise a locking plate, the opposite ends of which press against the arms of the U-shaped body and can be locked to the slider by means of a fixing grub-screw.

* * * * *